US009682422B2

(12) United States Patent
Honda et al.

(10) Patent No.: US 9,682,422 B2
(45) Date of Patent: Jun. 20, 2017

(54) CONTINUOUS CASTING METHOD

(71) Applicant: NISSHIN STEEL CO., LTD., Tokyo (JP)

(72) Inventors: Yuuki Honda, Yamaguchi (JP); Hiroshi Morikawa, Yamaguchi (JP); Hiroaki Cho, Yamaguchi (JP); Noriaki Nukushina, Yamaguchi (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 0 days.

(21) Appl. No.: 15/025,184

(22) PCT Filed: Sep. 24, 2014

(86) PCT No.: PCT/JP2014/075272
§ 371 (c)(1),
(2) Date: Mar. 25, 2016

(87) PCT Pub. No.: WO2015/046241
PCT Pub. Date: Apr. 2, 2015

(65) Prior Publication Data

US 2016/0214166 A1 Jul. 28, 2016

(30) Foreign Application Priority Data

Sep. 27, 2013 (JP) ..... 2013-200838

(51) Int. Cl.
*B22D 11/106* (2006.01)
*B22D 11/111* (2006.01)
(Continued)

(52) U.S. Cl.
CPC ..... *B22D 11/041* (2013.01); *B22D 1/002* (2013.01); *B22D 11/002* (2013.01);
(Continued)

(58) Field of Classification Search
CPC ... B22D 11/002; B22D 11/106; B22D 11/108; B22D 11/11; B22D 11/111; B22D 11/117
(Continued)

(56) References Cited

U.S. PATENT DOCUMENTS 6,436,205 B1 * 8/2002 Behrens ..... B21B 1/46 148/508
2010/0136363 A1 * 6/2010 Valdez ..... B22D 11/111 428/586
2013/0122320 A1 * 5/2013 Chae ..... B22D 11/002 428/544

FOREIGN PATENT DOCUMENTS

CN 201644737 U * 11/2010
JP 05237613 A * 9/1993
(Continued)

OTHER PUBLICATIONS

EPO machine translation of JP 2000-273585, Oct. 3, 2000.*
(Continued)

*Primary Examiner* — Kevin E. Yoon
(74) *Attorney, Agent, or Firm* — Rothwell, Figg, Ernst & Manbeck, P.C.

(57) ABSTRACT

In a continuous casting method for casting an aluminum-deoxidized molten stainless steel 1 by using a continuous casting apparatus 100 in which a long nozzle 3 extending into a tundish 101 is provided at a ladle 2, the molten stainless steel 1 is poured through the long nozzle 3 into the tundish 101, while immersing a spout 3*a* into the poured molten stainless steel 1, and the molten stainless steel 1 in the tundish 101 is poured into a casting mold 105. A TD powder 5 is sprayed so that the powder covers the surface of the molten stainless steel 1 in the tundish 101, a nitrogen gas is supplied around the molten stainless steel 1, and a calcium-containing material is added to the molten stainless
(Continued)

steel 1 in the tundish 101. The surface of the molten stainless steel 1 after casting is ground.

4 Claims, 3 Drawing Sheets

(51) Int. Cl.

| | |
|---|---|
| ***B22D 11/041*** | (2006.01) |
| ***B22D 1/00*** | (2006.01) |
| ***B22D 11/00*** | (2006.01) |
| ***B22D 11/108*** | (2006.01) |
| ***B22D 31/00*** | (2006.01) |

(52) U.S. Cl.
CPC ..... *B22D 11/106* (2013.01); *B22D 11/108* (2013.01); *B22D 11/111* (2013.01); *B22D 31/002* (2013.01)

(58) Field of Classification Search
USPC ..... 164/473, 475, 476
See application file for complete search history.

(56) References Cited

FOREIGN PATENT DOCUMENTS

| | | | | |
|---|---|---|---|---|
| JP | H06599 | A | | 1/1994 |
| JP | 6-39505 | A | | 2/1994 |
| JP | H08164455 | A | | 6/1996 |
| JP | 2000273585 | A | * | 10/2000 |
| JP | 2002-35894 | A | | 2/2002 |
| JP | 2008-238259 | A | | 10/2008 |
| JP | 2012061516 | A | * | 3/2012 |

OTHER PUBLICATIONS

EPO machine translation of JP 2012-061516, Mar. 29, 2012.*
EPO machine translation of CN 201644737 U, Nov. 24, 2010.*
International Search Report issued in PCT Appln. No. PCT/JP2014/075272 on Dec. 22, 2014, 1 page.
Supplementary European Search Report for EP14849983 dated Mar. 28, 2017, 6 pages.

* cited by examiner

CONTINUOUS CASTING METHOD

CROSS REFERENCE TO RELATED APPLICATIONS

This application is a 35 U.S.C. §371 National Phase Entry Application from PCT/JP2014/075272, filed Sep. 24, 2014, and designating the United States, which claims priority to Japanese Patent Application No. 2013-200838, filed Sep. 27, 2013. The above identified applications are incorporated herein by reference in their entirety.

TECHNICAL FIELD

This invention relates to a continuous casting method.

BACKGROUND ART

In the process for manufacturing stainless steel, which is a kind of metal, molten iron is produced by melting raw materials in an electric furnace, molten steel is obtained by subjecting the produced molten iron to refining including decarburization for instance performed to remove carbon, which degrades properties of the stainless steel, in a converter and a vacuum degassing apparatus, and the molten steel is thereafter continuously cast to solidify to form a plate-shaped slab for instance. In the refining process, the final composition of the molten steel is adjusted.

In the continuous casting process, molten steel is poured from a ladle into a tundish and then poured from the tundish into a casting mold for continuous casting to cast. In this process, a seal gas shielding the molten steel surface from the atmosphere is supplied around the molten steel transferred from the ladle in the tundish to the casting mold in order to prevent the molten steel with the finally adjusted composition from reacting with nitrogen or oxygen contained in the atmosphere, such a reaction increasing the content of nitrogen or causing oxidation.

For example, PTL 1 discloses a method for manufacturing a continuously cast slab by using an argon gas as the seal gas.

CITATION LIST

Patent Literature

[PTL 1]

Japanese Patent Application Publication No. H4-284945.

SUMMARY OF INVENTION

Technical Problem

However, where the argon gas is used as the seal gas, as in the manufacturing method of PTL 1, the argon gas taken into the molten steel remains on the steel surface and inside thereof in the form of bubbles. The resultant problem is that since the regions including the bubbles degrade the slab quality, surface defect regions from the slab surface to the regions where the bubbles have been formed need to be removed by surface grinding over the entire slab, increasing the cost.

Further, some stainless steel grades include easily oxidizable titanium as a component. When stainless steel of such grades is refined, aluminum deoxidation aimed at removal of oxygen contained in the molten steel is performed by adding aluminum, which reacts with oxygen even more easily, thereby preventing the reaction of titanium with oxygen blown into the steel for decarburization. Aluminum reacts with oxygen and forms alumina, thereby removing the oxygen contained in the molten steel. However, the problem associated with this process is that since alumina has a high melting point of 2020° C., alumina contained in the molten steel precipitates in the casting process in which the temperature of the molten steel decreases, and the precipitated alumina adheres to and deposits on the inner wall of the nozzle extending from the tundish to the casting mold, thereby clogging the nozzle. Yet another problem is that alumina is present as large inclusions on the surface of the solidified slab and inside thereof, thereby creating surface defects.

The present invention has been created to resolve the above-described problems, and it is an objective of the invention to provide a continuous casting method in which surface defects in a slab (solid metal) obtained by casting a molten steel are reduced, while preventing a nozzle extending from a tundish to casting mold from clogging during casting of an aluminum-deoxidized molten steel (molten metal).

Solution to Problem

In order to resolve the above-described problems, the present invention provides a continuous casting method for casting a solid metal by pouring a molten metal, subjected to aluminum deoxidation in a ladle, into a tundish and continuously pouring the molten metal in the tundish into a casting mold, the continuous casting method including: a long nozzle installation step for providing in the ladle a long nozzle extending into the tundish as a pouring nozzle for pouring the molten metal in the ladle into the tundish; a casting step for pouring the molten metal into the tundish through the long nozzle, while immersing a spout of the long nozzle into the molten metal poured into the tundish, and pouring the molten metal in the tundish into the casting mold; a spraying step for spraying a tundish powder so that the powder covers the surface of the molten metal in the tundish; a seal gas supply step for supplying a nitrogen gas as a seal gas around the molten metal sprayed with the tundish powder; a calcium-containing material addition step for adding a calcium-containing material to the molten metal retained in the tundish; and a grinding step for grinding the surface of the cast solid metal.

Advantageous Effects of the Invention

With the continuous casting method in accordance with the present invention, surface defects in a solid metal obtained by casting a molten steel can be reduced, while preventing clogging of a nozzle extending from a tundish to a casting mold during casting of an aluminum-deoxidized molten metal.

DESCRIPTION OF EMBODIMENTS

Embodiment

The continuous casting method according to an embodiment of the invention will be explained hereinbelow in greater detail with reference to the appended drawings. Explained in the below-described embodiment is a method for continuously casting stainless steel including titanium (Ti) as a component, such a stainless steel requiring deoxidation with aluminum in a secondary refining process.

Stainless steel is manufactured by implementing a melting process, a primary refining process, a secondary refining process, and a casting process in the order of description.

In the melting process, scrap or alloys serving as starting materials for stainless steel production are melted in an electric furnace to produce molten iron, and the produced molten iron is transferred into a converter. In the primary refining process, crude decarburization is performed to remove carbon contained in the melt by blowing oxygen into the molten iron in the converter, thereby producing a molten stainless steel and a slag including oxides and impurities. Further, in the primary refining process, the components of the molten stainless steel are analyzed and crude adjustment of the components is implemented by charging alloys for bringing the steel composition close to the target composition. The molten stainless steel produced in the primary refining process is tapped into a ladle and transferred to the secondary refining process.

In the secondary refining process, the molten stainless steel is introduced, together with the ladle, into a vacuum oxygen decarburization apparatus (vacuum degassing apparatus, abbreviated as VOD, referred to hereinbelow as VOD), and finishing decarburization treatment, final desulfurization, removal of gases such as oxygen, nitrogen, and hydrogen, and removal of inclusions are performed. As a result of the above-described treatment, a molten stainless steel having the target properties of a product is obtained. Further, in the secondary refining process, the components of the molten stainless steel are analyzed and final adjustment of the components is implemented by charging alloys for bringing the steel composition close to the target composition.

Figure 1:
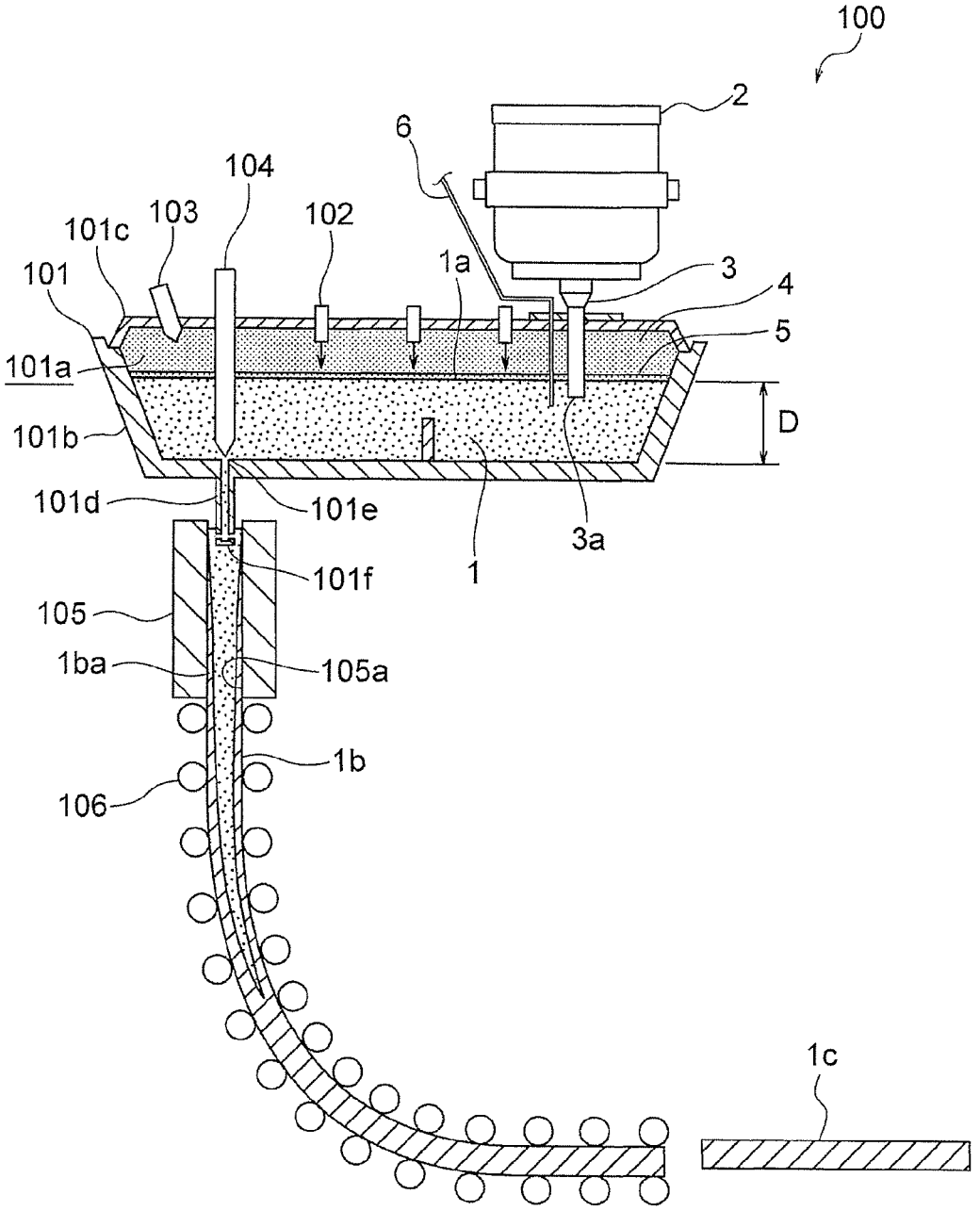
FIG. 1 is a schematic diagram illustrating the configuration of a continuous casting apparatus which is used in the continuous casting method according to an embodiment of the invention.

Referring to FIG. 1, in the casting process, the ladle 2 is taken out from the VOD and set at a continuous casting apparatus (CC) 100. Molten stainless steel 1 in the ladle 2 is poured into the continuous casting apparatus 100 and cast, for example, into a slab-shaped stainless steel 1*c* as a solid metal with a casting mold 105 provided in the continuous casting apparatus 100. The cast stainless steel billet 1*c* is hot rolled or cold rolled in the subsequent rolling process (not illustrated in the figures) to obtain a hot-rolled steel strip or cold-rolled steel strip.

Here, the molten stainless steel 1 constitutes a molten metal.

The configuration of the continuous casting apparatus (CC) 100 will be explained hereinbelow in greater detail.

Further, referring to FIG. 1, the continuous casting apparatus 100 has a tundish 101 which is a container for temporarily retaining the molten stainless steel 1 transferred from the ladle 2 and transferring the molten stainless steel to the casting mold 105. The tundish 101 has a main body 101*b* which is open at the top, an upper lid 101*c* that closes the open top of the main body 101*b* and shields the main body from the outside, and an immersion nozzle 101*d* extending from the bottom of the main body 101*b*. In the tundish 101, a closed inner space 101*a* is formed inside thereof by the main body 101*b* and the upper lid 101*c*. The immersion nozzle 101*d* is opened from the bottom of the main body 101*b* in the inner space 101*a* at the inlet port 101*e*.

Further, the ladle 2 is set above the tundish 101, and a long nozzle 3 which is a pouring nozzle extending through the upper lid 101*c* into the inner space 101*a* is connected to the bottom of the ladle 2. A spout 3*a* at the lower tip of the long nozzle 3 is opened in the inner space 101*a*. Sealing is performed and gas tightness is ensured between the long nozzle 3 and the upper lid 101*c*.

A plurality of gas supply nozzles 102 are provided in the upper lid 101*c*. The gas supply nozzles 102 are connected to a gas supply source (not depicted in the figures) and deliver a predetermined gas from the top downward into the inner space 101*a*. The long nozzle 3 is configured such that the predetermined gas is also supplied into the long nozzle.

A powder nozzle 103 is provided in the upper lid 101*c*, which is for charging a tundish powder (referred to hereinbelow as "TD powder") 5 from the top downward into the inner space 101*a*. The powder nozzle 103 is connected to a TD powder supply source (not depicted in the figure). The TD powder 5 is constituted by a synthetic slag agent, or the like, and where the surface of the molten stainless steel 1 is covered thereby, the following effects are produced on the molten stainless steel 1: the surface of the molten stainless steel 1 is prevented from oxidation, the temperature of the molten stainless steel 1 is maintained, and inclusions contained in the molten stainless steel 1 are dissolved and absorbed.

A rod-shaped stopper 104 movable in the vertical direction is provided above the immersion nozzle 101*d*. The stopper 104 extends from the inner space 101*a* of the tundish 101 to the outside through the upper lid 101*c*.

Where the stopper 104 is configured such that where the stopper is moved downward, the tip thereof can close the inlet port 101*e* of the immersion nozzle 101*d*, and also such that where the stopper is pulled upward from a position in which the inlet port 101*e* is closed, the molten stainless steel 1 inside the tundish 101 is caused to flow into the immersion nozzle 101*d* and the flow rate of the molten stainless steel can be controlled by adjusting the opening area of the inlet port 101*e* according to the amount of pull-up. Further, sealing is performed and gas tightness is ensured between the stopper 104 and the upper lid 101*c*.

The tip 101*f* of the immersion nozzle 101*d* protruding from the bottom portion of the tundish 101 to the outside extends into a through hole 105*a* of the casting mold 105, which is located therebelow, and opens sidewise.

The through hole 105*a* has a rectangular cross section and passes through the casting mold 105 in the vertical direction. The through hole 105*a* is configured such that the inner wall surface thereof is water cooled by a primary cooling mechanism (not depicted in the figure). As a result, the molten stainless steel 1 inside is cooled and solidified and a slab 1*b* of a predetermined cross section is formed.

A plurality of rolls 106 for pulling downward and transferring the slab 1*b* formed by the casting mold 105 are provided apart from each other below the through hole 105*a* of the casting mold 105. A secondary cooling mechanism (not depicted in the figure) for cooling the slab 1*b* by spraying water is provided between the rolls 106.

The operation of the continuous casting apparatus 100 and the peripheral components thereof when the continuous casting method of the present embodiment is implemented will be explained hereinbelow.

Figure 2:
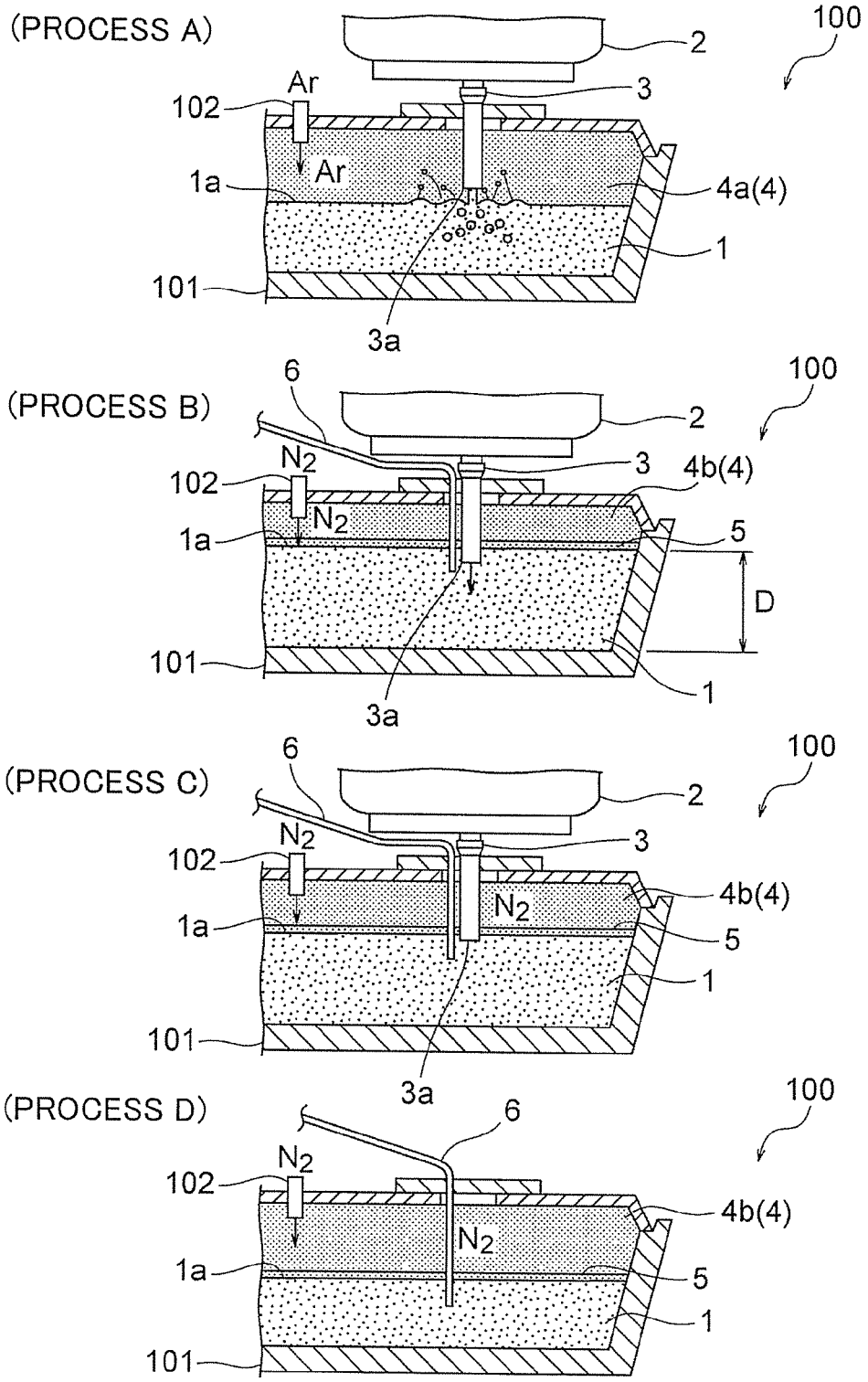
FIG. 2 is a schematic diagram illustrating the state of a tundish depicted in FIG. 1 during the continuous casting.

Referring to FIG. 1 together with FIG. 2, the ladle 2 containing inside thereof the molten stainless steel 1 which includes Ti as a component and has been taken out from the VOD (not depicted in the figure) after the secondary refining process is disposed above the tundish 101 in the continuous casting apparatus 100.

The secondary refining process of the molten stainless steel involves finish decarburization, final desulfurization, removal of gases such as oxygen, nitrogen, and hydrogen, removal of inclusions, and the addition of Ti which is a component.

In the finishing decarburization, oxygen is blown into the molten stainless steel, and carbon contained in the molten stainless steel is removed by a reaction with the blown oxygen and oxidation into carbon monoxide. As a result, the molten stainless steel in the secondary refining process includes oxygen which has not reacted with carbon. In the aforementioned degassing aimed at the removal of oxygen, an alloy including aluminum (Al) which is higher than Ti in reactivity with oxygen is added as a deoxidizer (oxygen scavenging agent) to the molten stainless steel prior to adding Ti which easily reacts with oxygen. The Al contained in the alloy including Al reacts with the oxygen contained in the molten stainless steel and forms alumina ($Al_2O_3$). Most of $Al_2O_3$ aggregates in the molten stainless steel and is separated as slag, but part thereof remains in the molten stainless steel. In other words, Ti which is a component is added to the molten stainless steel after the oxygen contained therein has been removed by adding the alloy including Al. As a result, since Al reacts with oxygen and removes it in the molten stainless steel before the oxygen reacts with Ti, the oxidation of Ti is suppressed.

In the continuous casting apparatus 100 in which the ladle 2 containing the aluminum-deoxidized molten stainless steel 1 is disposed in the tundish 101, the long nozzle 3 is mounted on the bottom of the ladle 2, and the tip of the long nozzle 3 having the spout 3*a* extends into the inner space 101*a* of the tundish 101. In this configuration, the stopper 104 closes the inlet port 101*e* of the immersion nozzle 101*d*.

Then, an argon (Ar) gas 4*a* which is an inert gas is injected as a seal gas 4 from the gas supply nozzle 102 into the inner space 101*a* of the tundish 101, and the Ar gas 4*a* is also supplied into the long nozzle 3. As a result, the air which is present in the inner space 101*a* and the long nozzle 3 and includes impurities is pushed out of the tundish 101 to the outside, and the inner space 101*a* and the long nozzle 3 are filled with the Ar gas 4*a*. In other words, the region from the ladle 2 to the inner space 101*a* of the tundish 101 is filled with the Ar gas 4*a*.

A valve (not depicted in the figure) which is provided at the ladle 2 is then opened, and the molten stainless steel 1 in the ladle 2 flows down under gravity inside the long nozzle 3 and into the inner space 101*a*. In other words, the interior of the tundish 101 is in the state illustrated by a process A in FIG. 2.

At this time, the molten stainless steel 1 which has flowed in is sealed on the periphery thereof with the Ar gas 4*a* filling the inner space 101*a* and is not in contact with the air. As a result, nitrogen ($N_2$) which is contained in air and can be dissolved in the molten stainless steel 1 is prevented from dissolving in the molten stainless steel 1 and increasing the concentration of $N_2$ component therein. For this reason, the formation of TiN by contact and reaction of the nitrogen component (N) and the Ti contained as a component in the molten stainless steel 1 is suppressed. TiN forms clusters and is present as large inclusions (for example, with a diameter about 230 μm) in the molten stainless steel 1. However, since the formation of large inclusions by TiN is suppressed, the precipitation of TiN as large inclusions is also suppressed in the molten stainless steel 1 which has been cooled and solidified.

Further, inside the tundish 101, the molten stainless steel 1 which has flowed down from the spout 3*a* of the long nozzle 3 hits the surface 1*a* of the retained molten stainless steel 1. As a result, the Ar gas 4*a* is dragged in and mixed, albeit in a small amount, with the molten stainless steel 1. However, the Ar gas 4*a* does not react with the molten stainless steel 1.

Further, inside the tundish 101, the surface 1*a* of the molten stainless steel 1 is raised by the inflowing molten stainless steel 1. Where the rising surface 1*a* reaches the vicinity of the spout 3*a* of the long nozzle 3, the intensity with which the molten stainless steel 1 flowing down from the spout 3*a* hits the surface 1*a* decreases and the amount of the surrounding gas which is dragged in also decreases. Therefore, the TD powder 5 is sprayed from the powder nozzle 103 towards the surface 1*a* of the molten stainless steel 1. The TD powder 5 is sprayed to cover the entire surface 1*a*.

After the TD powder 5 has been sprayed, a nitrogen ($N_2$) gas 4*b*, which is an inert gas, is injected instead of the Ar gas 4*a* from the gas supply nozzle 102. As a result, inside the inner space 101*a* of the tundish 101, the Ar gas 4*a* is pushed out to the outside, and the region between the TD powder 5 and the upper lid 101*c* of the tundish 101 is filled with the $N_2$ gas 4*b*.

At this time, the TD powder 5 accumulated in a layer configuration on the surface 1*a* of the molten stainless steel 1 blocks contact between the surface 1*a* of the molten stainless steel 1 and the $N_2$ gas 4*b* and prevents the $N_2$ gas 4*b* from dissolving in the molten stainless steel 1. As a result, contact between the nitrogen component (N) and Ti included as a component in the molten stainless steel 1 is suppressed and the formation of TiN is suppressed. Therefore, the formation of large inclusions by TiN in the molten stainless steel 1 is suppressed. Further, the precipitation of TiN as large inclusions is also suppressed in the molten stainless steel 1 which has been cooled and solidified.

Further, in the secondary refining process, part of $Al_2O_3$ generated in the deoxidation treatment is not separated as slag and remains in the molten stainless steel 1. Since $Al_2O_3$ has a high melting point of 2020° C., it precipitates and forms clusters in the molten stainless steel 1 and is also present in the form of large inclusions in the solidified molten stainless steel 1. Further, $Al_2O_3$ precipitated in the molten stainless steel 1 can adhere and accumulate inside the immersion nozzle 101*d* and in the vicinity thereof, thereby clogging the immersion nozzle 101*d*.

For this reason, a calcium-containing wire (referred to hereinbelow as Ca-containing wire) 6, which is a calcium-containing material, is charged into the molten stainless steel 1 after the TD powder 5 has been sprayed. The Ca-containing wire 6 is disposed to extend from the outside of the tundish 101 through the upper lid 101*c* into the inner space 101*a* and be immersed through the layer of the TD powder 5 into the molten stainless steel 1. Examples of the Ca-containing wire 6 include a calcium wire (Ca wire) and a calcium silicon wire (CaSi wire).

$Al_2O_3$ and Ca contained in the Ca-containing wire 6 react with each other, thereby changing the $Al_2O_3$ into calcium aluminate ($12CaO.7Al_2O_3$). Since the Ca-containing wire 6 is decomposed and consumed by reaction with $Al_2O_3$, the wire is successively fed into the molten stainless steel 1 as the reaction proceeds.

The generated $12CaO.7Al_2O_3$ has a melting temperature of 1400°, which is substantially lower than the melting point of $Al_2O_3$, and dissolves and disperses in the molten stainless steel 1. Therefore, $12CaO.7Al_2O_3$ does not precipitate as large inclusions, such as formed by $Al_2O_3$, in the molten stainless steel 1 and does not clog the immersion nozzle 101*d* by precipitating and adhering inside and in the vicinity thereof.

However, since the Ca-containing wire 6 inserted into the molten stainless steel 1 and dissolved therein reacts with $Al_2O_3$, the layer of the TD powder 5 in the charging region of the Ca-containing wire 6 is disrupted. In this disrupted region, the $N_2$ gas 4*b* comes into contact and reacts with Ti contained in the molten stainless steel 1 and TiN is formed, albeit in a very small amount, in the molten stainless steel 1. Since the amount of the formed TiN is very small, it precipitates in a very shallow region close to the surface of the cooled and solidified molten stainless steel 1.

Therefore, in the molten stainless steel 1, the precipitation of $Al_2O_3$ is suppressed, while the amount of TiN precipitating due to the dissolution of the $N_2$ gas 4*b* is reduced. Further, since the Ca-containing wire 6 is charged into the molten stainless steel 1 in the tundish 101 immediately before casting, even when $12CaO.7Al_2O_3$ has precipitated, it is dissolved and dispersed.

Further, inside the inner space 101*a* of the tundish 101, where the rising surface 1*a* causes the spout 3*a* of the long nozzle 3 to dip into the molten stainless steel 1 and the depth of the molten stainless steel 1 in the inner space 101*a* becomes a predetermined depth D, the stopper 104 rises. As a result, the molten stainless steel 1 in the inner space 101*a* flows into the through hole 105*a* of the casting mold 105 through the interior of the immersion nozzle 101*d*, and casting is started. At the same time, the molten stainless steel 1 inside the ladle 2 is continuously poured through the long nozzle 3 into the inner space 101*a* and new molten stainless steel 1 is supplied into the inner space 101*a*. The interior of the tundish 101 at this time is in a state such as illustrated by process B in FIG. 2.

In the course of casting, the outflow rate of the molten stainless steel 1 from the immersion nozzle 101*d* and the inflow rate of the molten stainless steel 1 through the long nozzle 3 are adjusted such that the molten stainless steel 1 maintains the depth which is close to the predetermined depth D and the surface 1*a* of the molten stainless steel 1 is at a substantially constant position, while maintaining the spout 3*a* of the long nozzle 3 in a state of immersion in the molten stainless steel 1 in the tundish 101.

When the molten stainless steel 1 in the inner space 101*a* has the predetermined depth D, it is preferred that the long nozzle 3 penetrate into the molten stainless steel 1 such that the spout 3*a* be at a depth of about 100 mm to 150 mm from the surface 1*a* of the molten stainless steel 1. Where the long nozzle 3 penetrates to a depth larger than that indicated hereinabove, it is difficult for the molten stainless steel 1 to flow out from the spout 3*a* due to the resistance produced by the internal pressure of the molten stainless steel 1 remaining in the inner space 101*a*. Meanwhile, where the long nozzle 3 penetrates to a depth less than that indicated hereinabove, the surface 1*a* of the molten stainless steel 1, which is controlled such as to be maintained in the vicinity of a predetermined position during casting, can change and the spout 3*a* can be exposed. In such cases, the molten stainless steel 1 which has been poured out hits the surface 1*a* and the $N_2$ gas 4*b* can be dragged in and mixed with the steel.

The molten stainless steel 1 which has flowed into the through hole 105*a* of the casting mold 105 is cooled by the primary cooling mechanism (not depicted in the figure) in the process of flowing through the through hole 105*a*, the steel on the inner wall surface side of the through hole 105*a* is solidified, and a solidified shell 1*ba* is formed. A mold powder is supplied from a tip 101*f* side of the immersion nozzle 101*d* to the inner wall surface of the through hole 105*a*. The mold powder acts to induce slag melting on the surface of the molten stainless steel 1, prevent the oxidation of the surface of the molten stainless steel 1 inside the through hole 105*a*, ensure lubrication between the casting mold 105 and the solidified shell 1*ba*, and maintain the temperature of the surface of the molten stainless steel 1 inside the through hole 105*a*.

The slab 1*b* is formed by the solidified shell 1*ba* and the non-solidified molten stainless steel 1 inside thereof, and the slab 1*b* is grasped from both sides by rolls 106 and pulled further downward and out. In the process of being transferred between the rolls 106, the slab 1*b* which has been pulled out is cooled by water spraying with the secondary cooling mechanism (not depicted in the figure), and the molten stainless steel 1 inside thereof is completely solidified. As a result, by forming a new slab 1*b* inside the casting mold 105, while pulling out the slab 1*b* from the casting mold 105 with the rolls 106, it is possible to form the slab 1*b* which is continuous over the entire extension direction of the rolls 106 from the casting mold 105. The slab 1*b* which is fed out by the rolls 106 is cut to form a slab-shaped stainless steel billet 1*c*. Where surface defects such as bubbles and inclusions are present in the stainless steel billet 1*c*, surface grinding is performed to remove uniformly the entire surface layer.

The stopper 104 is controlled to adjust the opening area of the inlet port 101 e of the immersion nozzle 101*d* to maintain the surface of the molten stainless steel 1 inside the through hole 105*a* of the casting mold 105 at a constant height. As a result, the outflow rate of the molten stainless steel 1 is controlled. Furthermore, the inflow rate of the molten stainless steel 1 from the ladle 2 through the long nozzle 3 is adjusted such as to be equal to the outflow rate of the molten stainless steel 1 from the inlet port 101*e*. As a result, the surface 1*a* of the molten stainless steel 1 in the inner space 101*a* of the tundish 101 is controlled such as to maintain a substantially constant position in the vertical direction in a state in which the depth of the molten stainless steel 1 remains close to the predetermined depth D. At this time, the spout 3*a* at the distal end of the long nozzle 3 is immersed into the molten stainless steel 1. Further, the casting state in which the vertical position of the surface 1*a* of the molten stainless steel 1 is maintained substantially constant, while the spout 3*a* is immersed into the molten stainless steel 1 in the tundish 101, as mentioned hereinabove, is called a stationary state.

Therefore, as long as the casting is performed in the stationary state, in the inner space 101*a*, the molten stainless steel 1 flowing in from the long nozzle 3 does not hit the surface 1*a* or the TD powder 5 and only the layer of the TD powder 5 is disturbed around the Ca-containing wire 6. Therefore, a state is maintained in which the $N_2$ gas 4*b* is practically shielded from the molten stainless steel 1 by the TD powder 5. As a result, the dissolution of the $N_2$ gas 4*b* in the molten stainless steel 1 is suppressed. The precipitation of large inclusions formed by TiN and $Al_2O_3$ in the molten stainless steel 1 is also suppressed.

When no molten stainless steel 1 remains inside the ladle 2, the long nozzle 3 is detached from the ladle 2 and the ladle is replaced with another ladle 2 containing the molten stainless steel 1, while the long nozzle 3 is left in the tundish 101. The long nozzle 3 is connected again to the replacement ladle 2. The casting operation is also continuously performed during the replacement of the ladle 2. As a result, the surface 1*a* of the molten stainless steel 1 in the inner space 101*a* of the tundish 101 is lowered. The supply of the $N_2$ gas 4*b* into the inner space 101*a* and the insertion of the Ca-containing wire 6 into the molten stainless steel 1 are also continued during the replacement of the ladle 2. The interior of the tundish 101 at this time is in a state such as illustrated by process C in FIG. 2.

During the replacement of the ladle 2, the opening area of the inlet port 101*e* of the immersion nozzle 101*d* is adjusted with the stopper 104 and the outflow rate of the molten stainless steel 1, that is, the casting rate, is controlled such that the surface 1*a* of the molten stainless steel 1 in the inner space 101*a* does not fall below the spout 3*a* of the long nozzle 3. By continuously casting the molten stainless steel 1 of the plurality of ladles 2 in the above-described manner, it is possible to eliminate a seam in the slab 1*b* which occurs when the ladle 2 is replaced. Further, the change in quality of the slab 1*b* in the initial period of casting which occurs each time the ladle 2 is replaced can be reduced. Further, it is possible to omit a step for retaining the molten stainless steel 1 in the tundish 101 until the casting is started, such a step being necessary when the casting is ended for each single ladle 2.

Further, when the casting advances so no molten stainless steel 1 remains in the replacement ladle 2, and the casting is ended, the ladle 2 and the long nozzle 3 are removed. The interior of the tundish 101 at this time is in a state such as illustrated by process D in FIG. 2. At this time, there is no new downward flow of the molten stainless steel 1, the surface 1*a* and the TD powder 5 are not disturbed by the falling steel, and only the layer of the TD powder 5 around the Ca-containing wire 6 is disturbed. Therefore, the $N_2$ gas 4*b* is prevented from dissolving in the molten stainless steel 1 until the end of the casting. The precipitation of large inclusions in the molten stainless steel 1 is also suppressed.

Even before the spout 3*a* of the long nozzle 3 is immersed into the molten stainless steel 1 in the inner space 101*a* (see process A in FIG. 2), the admixture of the air and Ar gas 4*a* caused by dragging into the molten stainless steel 1 is reduced because the distance between the spout 3*a* and the bottom of the main body 101*b* of the tundish 101 is small, the distance between the spout 3*a* and the surface 1*a* of the molten stainless steel 1 which is being poured is small, and the surface 1*a* is hit by the molten stainless steel 1 only for a limited short period of time until the spout 3*a* is immersed.

Where the $N_2$ gas 4*b* is used instead of the Ar gas as the seal gas when the surface 1*a* is hit by the molten stainless steel 1, or where the TD powder 5 is sprayed on the surface 1*a* and the $N_2$ gas 4*b* is used as the seal gas, excessive amount of $N_2$ gas 4*b* can be dissolved in the molten stainless steel 1 and this component can make the steel unsuitable as a product. In addition, a large amount of inclusions caused by TiN can be formed. Therefore, it may be necessary to dispose of the entire stainless steel billet 1*c* which has been cast from the molten stainless steel 1 remaining in the inner space 101*a* in the initial period of casting until the spout 3*a* of the long nozzle 3 is immersed. However, by using the Ar gas 4*a* in the initial period of casting, it is possible to fit the components of the molten stainless steel 1 into the prescribed ranges, without causing significant changes thereof, and to prevent the formation of TiN. Further, in the initial period of casting, the precipitation of large inclusions formed by $Al_2O_3$ is also small. Therefore, the stainless steel billet 1*c* cast from the molten stainless steel 1 to which very small amount of air or Ar gas 4*a* has been admixed in the initial period of casting contains practically no large inclusions and has the required composition. As a result, the billet can be used as a product after shallow surface grinding is performed to remove the large inclusions and bubbles created by the admixed Ar gas 4*a*.

Further, the stainless steel billet 1*c* which has been cast over a period of time other than the abovementioned initial period of casting, this period of time taking a major part of the casting interval of time from after the initial period of casting to the end of casting, is not affected by the air or Ar gas 4*a* that has been admixed in the initial period of casting, and it can be also said that the admixture of the $N_2$ gas 4*b* is suppressed by the TD powder 5. Further, even if the $N_2$ gas 4*b* is admixed, it is dissolved in the molten stainless steel 1 and therefore is unlikely to remain as bubbles. The amount of TiN formed by the reaction thereof with Ti is also very small. The TD powder 5 also acts to absorb the N component admixed to the molten stainless steel 1. Therefore, in the stainless steel 1*c* which is cast over a period of time other than the initial period of casting, the nitrogen content does not increase over that after the secondary refining, defects caused by bubbling of the admixed gas are practically absent, and large inclusions formed by TiN are present only within a very shallow surface region.

Further, in a period of time other than the initial period of casting, after the TD powder 5 has been sprayed over the molten stainless steel 1, the Ca-containing wire 6 is charged and the amount of contained $Al_2O_3$ is reduced. Therefore, the occurrence of inclusions formed by $Al_2O_3$ in the stainless steel billet 1*c* is greatly suppressed.

It follows from above, that in the stainless steel billet 1*c* cast over a period of time other than the initial period of casting, surface defects caused by bubbles are prevented and the number of surface defects caused by large inclusions constituted by TiN and $Al_2O_3$ is greatly reduced. Therefore, even when surface grinding is necessary, a product of desired quality can be obtained by grinding with a very small grinding depth.

EXAMPLES

Explained hereinbelow are the results obtained by examining the effect the Ca-containing wire produced on examples of stainless steel billets cast by using the continuous casting method according to the embodiment.

In the examples, the continuous casting method of the embodiment was applied to a Ti-added ferritic stainless steel. Compared hereinbelow are Examples 1 and 2 in which surface grinding was performed after a slab, which was a stainless steel billet, was cast, Comparative Examples 1 and 2 which were the same as Examples 1 and 2, except that no surface grinding was performed, and Comparative Examples 3 and 4 in which surface grinding was performed after casting a slab by using a continuous casting method different from that of the embodiment.

In Examples 1 and 2, the cast slabs of Comparative Examples 1 and 2 were surface ground to a depth of 2 mm.

In Comparative Examples 3 and 4, a slab was cast without spraying the TD powder by using a short nozzle with a distal end at the level of the lower surface of the upper lid 101*c* as the pouring nozzle and using only the Ar gas as the seal gas in the tundish 101 depicted in FIG. 1. Further, in Comparative Examples 3 and 4, the Ca-containing wire 6 was inserted and added to the molten stainless steel 1 in the tundish 101 at the time of casting. The cast slab was surface ground to a depth of 2 mm.

Specifications for the chemical compositions of the stainless steels in Examples 1 and 2 and Comparative Examples 1 to 4 are presented in Table 1 below. The specifications for the chemical compositions of the stainless steels in Example 1, Comparative Example 1, and Comparative Example 3 are the same, and the specifications for the chemical compositions of the stainless steels in Example 2, Comparative Example 2, and Comparative Example 4 are the same.

TABLE 1

Specifications for chemical compositions of stainless steels in examples and comparative examples

| | Chemical components (mass %) | | | | | | |
|---|---|---|---|---|---|---|---|
| | C | Cr | Si | Mn | Ti | Al | N |
| Example 1 | ≤0.030 | 17.25 | 0.30 | ≤0.50 | 0.60 | ≤0.10 | ≤0.020 |
| Example 2 | ≤0.030 | 10.00 | 0.90 | 0.25 | 0.15 | ≤0.07 | ≤0.015 |
| Comparative Example 1 | ≤0.030 | 17.25 | 0.30 | ≤0.50 | 0.60 | ≤0.10 | ≤0.020 |
| Comparative Example 2 | ≤0.030 | 10.00 | 0.90 | 0.25 | 0.15 | ≤0.07 | ≤0.015 |
| Comparative Example 3 | ≤0.030 | 17.25 | 0.30 | ≤0.50 | 0.60 | ≤0.10 | ≤0.020 |
| Comparative Example 4 | ≤0.030 | 10.00 | 0.90 | 0.25 | 0.15 | ≤0.07 | ≤0.015 |

The detection results presented hereinbelow were obtained for the examples by sampling from slabs cast in the stationary state, except for the initial period of casting, and for the comparative examples by sampling from the slabs cast within the period of time equal to the sampling period in the examples from the start of casting.

Casting conditions (type of seal gas, type of pouring nozzle, whether the TD powder was used, and whether the cast slab was surface ground) are presented for the examples and comparative examples in Table 2.

TABLE 2

Casting conditions in examples and comparative examples

| | Seal gas type | Pouring nozzle type | TD powder | Surface grinding |
|---|---|---|---|---|
| Example 1 | $N_2$ | Long nozzle | Used | Performed |
| Example 2 | $N_2$ | Long nozzle | Used | Performed |
| Comparative Example 1 | $N_2$ | Long nozzle | Used | Not performed |
| Comparative Example 2 | $N_2$ | Long nozzle | Used | Not performed |
| Comparative Example 3 | Ar | Short nozzle | Not performed | Performed |
| Comparative Example 4 | Ar | Short nozzle | Not performed | Performed |

Figure 3:
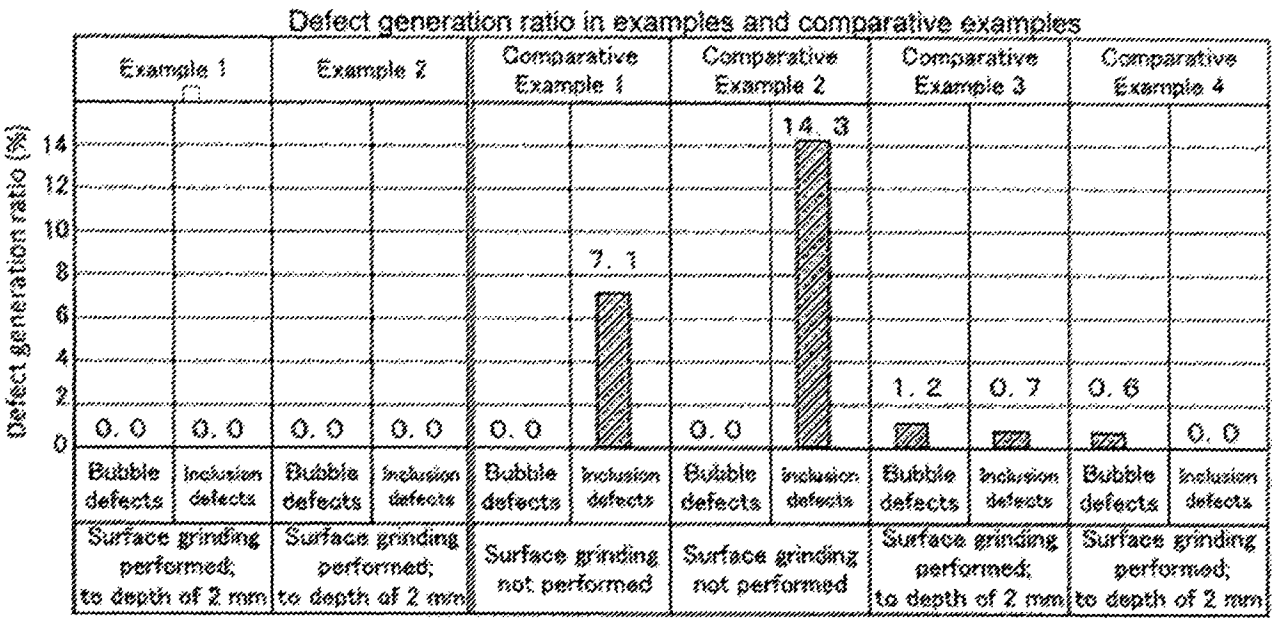
FIG. 3 is a table showing the ratio between the number of bubble defects and the number inclusion defects for Comparative Examples 1 to 4.

Further, in FIG. 3, the ratio of the number of slabs in which bubble defects were detected from a large number of cast slabs and the ratio of the number of slabs in which defects caused by inclusions were detected from the same slabs are compared for Examples 1 and 2 and Comparative Examples 1 to 4.

As shown in FIG. 3, in Examples 1 and 2, the number of defects caused by inclusions was reduced to zero, with respect to that in Comparative Examples 1 and 2, by surface grinding to a depth of 2 mm. Meanwhile, in Comparative Examples 3 and 4 the number of defects was not zero despite surface grinding to a depth of 2 mm. Therefore, the grinding amount of the slab can be greatly reduced in Examples 1 and 2 with respect to that in Comparative Examples 3 and 4.

The present invention was also applied to steel grades which were obtained by adding an Al-containing alloy as a deoxidizer in the secondary refining process and which included Ti as a component, such as 18Cr-1 Mo-0.5Ti and 22Cr-1.2Mo—Nb—Ti stainless steels, in addition to the above-described steel grades, and the immersion nozzle clogging prevention effect was confirmed.

The continuous casting method according to the embodiment is explained with reference to stainless steels including Ti as a component, but the method can be also effectively applied to stainless steels which require aluminum deoxidation in the secondary refining process and include Nb as a component.

Further, the continuous casting method according to the embodiment is applied to the production of stainless steel, but it may be also applied to the production of other metals.

The control in the tundish 101 in the continuous casting methods according to the embodiment is applied to continuous casting, but it may be also applied to other casting methods.

The invention claimed is:

1. A continuous casting method for casting a solid metal by pouring a molten metal, subjected to aluminum deoxidation in a ladle, into a tundish and continuously pouring the molten metal in the tundish into a casting mold, the continuous casting method including:

a long nozzle installation step for providing in the ladle a long nozzle extending into the tundish as a pouring nozzle for pouring the molten metal in the ladle into the tundish;

a casting step for pouring the molten metal into the tundish through the long nozzle, while immersing a spout of the long nozzle into the molten metal poured into the tundish, and pouring the molten metal in the tundish into the casting mold;

a spraying step for spraying a tundish powder so that the powder covers the surface of the molten metal in the tundish;

a seal gas supply step for supplying a nitrogen gas as a seal gas around the molten metal sprayed with the tundish powder;

a calcium-containing material addition step for adding a calcium-containing material to the molten metal retained in the tundish; and a grinding step for grinding the surface of the cast solid metal.

2. The continuous casting method of claim 1, wherein the molten metal includes titanium as a component.

3. The continuous casting method of claim 1, wherein the calcium-containing material is a calcium-containing wire, and the calcium-containing wire is added to the molten metal sprayed with the tundish powder.

4. The continuous casting method of claim 1, wherein before the tundish powder is sprayed, argon gas is supplied as a seal gas around the molten metal in the tundish.

* * * * *